US009810487B2

(12) United States Patent
Watson et al.

(10) Patent No.: US 9,810,487 B2
(45) Date of Patent: Nov. 7, 2017

(54) HEAT EXCHANGER WITH BAFFLE ASSEMBLY

(71) Applicant: TUBE TECH INTERNATIONAL LTD, Rayleigh, Essex (GB)

(72) Inventors: Michael Watson, Rayleigh (GB); Derek Sumsion, Stanford-le-Hope-Essex (GB)

(73) Assignee: Tube Tech International Ltd., Rayleigh, Essex (GB)

( * ) Notice: Subject to any disclaimer, the term of this patent is extended or adjusted under 35 U.S.C. 154(b) by 206 days.

(21) Appl. No.: 14/419,332

(22) PCT Filed: Jul. 29, 2013

(86) PCT No.: PCT/IB2013/056212
§ 371 (c)(1),
(2) Date: Feb. 3, 2015

(87) PCT Pub. No.: WO2014/020518
PCT Pub. Date: Feb. 6, 2014

(65) Prior Publication Data

US 2015/0211813 A1 Jul. 30, 2015

(30) Foreign Application Priority Data

Aug. 3, 2012 (GB) ..... 1213837.6

(51) Int. Cl.
*F28F 27/02* (2006.01)
*F28F 9/22* (2006.01)
(Continued)

(52) U.S. Cl.
CPC ..... *F28F 9/0243* (2013.01); *F28D 7/16* (2013.01); *F28F 9/0246* (2013.01);
(Continued)

(58) Field of Classification Search
CPC ..... F28F 9/0243; F28F 9/0246; F28F 9/026; F28F 9/0265; F28F 9/0268; F28F 9/028;
(Continued)

(56) References Cited

U.S. PATENT DOCUMENTS 2,768,814 A * 10/1956 Frey ..... F28F 9/0265 165/174
2,834,517 A * 5/1958 Townsley ..... B64D 37/20 222/144
(Continued)

FOREIGN PATENT DOCUMENTS

DE 2161604 6/1973
FR 2938321 5/2010
(Continued)

OTHER PUBLICATIONS

PCT International Searching Authority: International Search Report for PCT/1B2013/056212 dated May 8, 2013; entire document.

*Primary Examiner* — Leonard R Leo
(74) *Attorney, Agent, or Firm* — Allen Dyer Doppelt & Gilchrist

(57) ABSTRACT

A heat exchanger has an intake header, a discharge header, a bundle of tubes extending in parallel between the intake header and the discharge header, an intake pipe connected to the intake header and extending transversely to the axes of the tubes of the bundle, the intake pipe having a first end opening into the header and a second end connectable to a process fluid supply pipe, and a baffle assembly for modifying the direction and rate of flow of the process fluid through the intake header, the baffle assembly being located within the intake pipe and secured to the intake pipe at a position adjacent the second end of the intake pipe. The baffle assembly comprises a plurality of slats lying in planes generally parallel to one another and inclined to the direction of fluid flow, and runners connected to the ends thereof to form a rigid structure.

6 Claims, 2 Drawing Sheets

(51) Int. Cl.

| | |
|---|---|
| ***F28F 9/02*** | (2006.01) |
| ***F28F 19/00*** | (2006.01) |
| ***F28D 7/16*** | (2006.01) |
| ***F28F 9/04*** | (2006.01) |

(52) U.S. Cl.
CPC ..... *F28F 9/0268* (2013.01); *F28F 9/04* (2013.01); *F28F 19/00* (2013.01); *F28F 27/02* (2013.01); *F28F 9/026* (2013.01); *F28F 9/028* (2013.01); *F28F 2280/10* (2013.01)

(58) Field of Classification Search
CPC ..... F28F 9/04; F28F 9/12; F28F 9/24; F28F 2009/22; F28F 19/00; F28F 2280/10; F28F 27/02; F28D 7/16
USPC ..... 165/96, 98, 158, 174
See application file for complete search history.

(56) References Cited

U.S. PATENT DOCUMENTS 3,315,738 A * 4/1967 Jones, Jr. ..... F28B 9/04 165/174
4,531,576 A * 7/1985 Kals ..... F28F 27/02 165/96
4,573,526 A * 3/1986 Jung ..... F28F 9/0268 165/174
5,107,924 A * 4/1992 Herbert ..... F28F 9/0246 165/174
5,465,783 A * 11/1995 O'Connor ..... F28F 19/00 165/134.1
6,289,980 B1 * 9/2001 Insalaco ..... F28F 9/0243 165/174
2007/0079957 A1 * 4/2007 Tomura ..... F28F 9/0226 165/174
2008/0202735 A1 * 8/2008 Geskes ..... F28D 9/0006 165/166
2011/0226455 A1 * 9/2011 Al-Anizi ..... F28D 7/16 165/177

FOREIGN PATENT DOCUMENTS

GB 388927 3/1933
GB 388927 A * 3/1933 ..... F28B 9/04
JP 54117805 A * 9/1979
JP 55053700 A * 4/1980
JP H 01137138 A * 5/1989 ..... F24F 7/08

* cited by examiner

HEAT EXCHANGER WITH BAFFLE ASSEMBLY

CROSS-REFERENCE TO RELATED APPLICATIONS

This application is the §371 National Stage of International Application No. PCT/IB2013/056212, filed on Jul. 29, 2013, which claims the benefit of United Kingdom Patent Application Serial No. GB 1213837.6 filed on Aug. 3, 2012, the contents of which applications are hereby incorporated by reference in their entirety.

FIELD OF THE INVENTION

The present invention relates to a heat exchanger.

BACKGROUND OF THE INVENTION

In a heat exchanger of the type to which the present invention relates a bundle of parallel tubes extends between an intake header, connected to an intake pipe, and a discharge header. In operation, a process fluid flows through the tube bundle from the intake header to the discharge header and during its passage it is heated or cooled by heat transfer through the walls of the tubes.

The fluid flow rates through the individual tubes are not uniform, but are greater in the tubes near or in line with the intake pipe, as these offer less flow resistance. It is common for the intake pipe to be connected to a side of the intake header and to extend at an angle to the axis of the tubes in the bundle and in such a configuration, there is still greater variation in the flow rates through the individual tubes.

The fluid flowing through the tubes tends to leave a deposit on them, and, if allowed to build up, reduces the efficiency of the heat exchanger. The lower the flow rate of the fluid through a tube, the higher the rate at which such a deposit can build up. The uneven flow rates therefore lead to the tubes with the lowest flow rate becoming obstructed by a deposit more rapidly than would occur with uniform flow rates across the bundle.

To prevent a build up of deposit, it has been proposed to render heat exchanger self-cleaning by inserting constantly circulating scouring projectiles or balls into the intake header to wipe the inner walls of the tubes in the bundle during their passage from the intake header to the discharge header. However, because of the non-uniform flow rate, these balls tend not to flow regularly through the tubes where the flow rate is low and if a deposit is allowed to build up in a tube between the passage of scouring balls then there is a further risk of a scouring ball being jammed in the tube.

SUMMARY OF THE INVENTION

With a view to mitigating at least some of the foregoing disadvantages, the present invention provides heat exchanger having an intake header, a discharge header, a bundle of tubes extending in parallel with one another between the intake header and the discharge header, an intake pipe connected to the intake header and extending transversely to the axes of the tubes of the bundle, the intake pipe having a first end opening into the header and a second end connectable to a process fluid supply pipe, and a baffle assembly for modifying the direction and rate of flow of the process fluid through the intake header, the baffle assembly being located within the intake pipe and secured to the intake pipe at a position adjacent the second end of the intake pipe, wherein the baffle assembly comprises a plurality of slats lying in planes generally parallel to one another and inclined to the direction of fluid flow, and runners connected to the ends of the slats to form a rigid structure.

In some embodiments, the baffle assembly is located at least predominantly within the intake pipe. In such embodiments of the invention, the baffle assembly modifies the direction and speed of the process fluid entering the intake header instead of dividing the intake header into separate flow channels, as has previously been proposed in the prior art. Because no part of the baffle is secured within the intake header, existing heat exchangers can be modified without the need for them to be dismantled.

In some embodiments of the invention, the individual slats have a width that varies along their lengths and are shaped to promote streamline flow through the header from the intake pipe to the tubes of the bundle.

It is possible for a baffle assembly to be rigidly secured to the intake pipe, but alternatively the baffle assembly may be secured to the intake pipe for pivotal movement about an axle located near the second end of the intake pipe.

In either case, the baffle assembly may be secured at only one end to a position adjacent the second end of the intake pipe. Such a construction further simplifies installation in that the baffle assembly can be inserted into, and secured to, the intake pipe once the latter has been separated from the supply pipe. All the fastening for securing the baffle assembly in position can be accessed readily from the open mouth of the intake pipe.

If the baffle assembly is fixed then its slats may be designed to equalise fluid flow in the tubes of the bundle but if the baffle assembly is pivotable it can be designed to concentrate the fluid flow into one region of the header tank so that fluid flow rates through tubes in different regions of the tube bundle may be selectively or periodically varied by repositioning the baffle assembly. Constantly oscillating the baffle would, for example, have the effect of sweeping a jet of the process fluid that is flowing at more than the average speed of the fluid over the mouths of the tubes that open into the intake header.

BRIEF DESCRIPTION OF THE DRAWINGS

The invention will now be described further, by way of example, with reference to the accompanying drawings, in which.

DETAILED DESCRIPTION OF THE PREFERRED EMBODIMENTS

Figure 1:
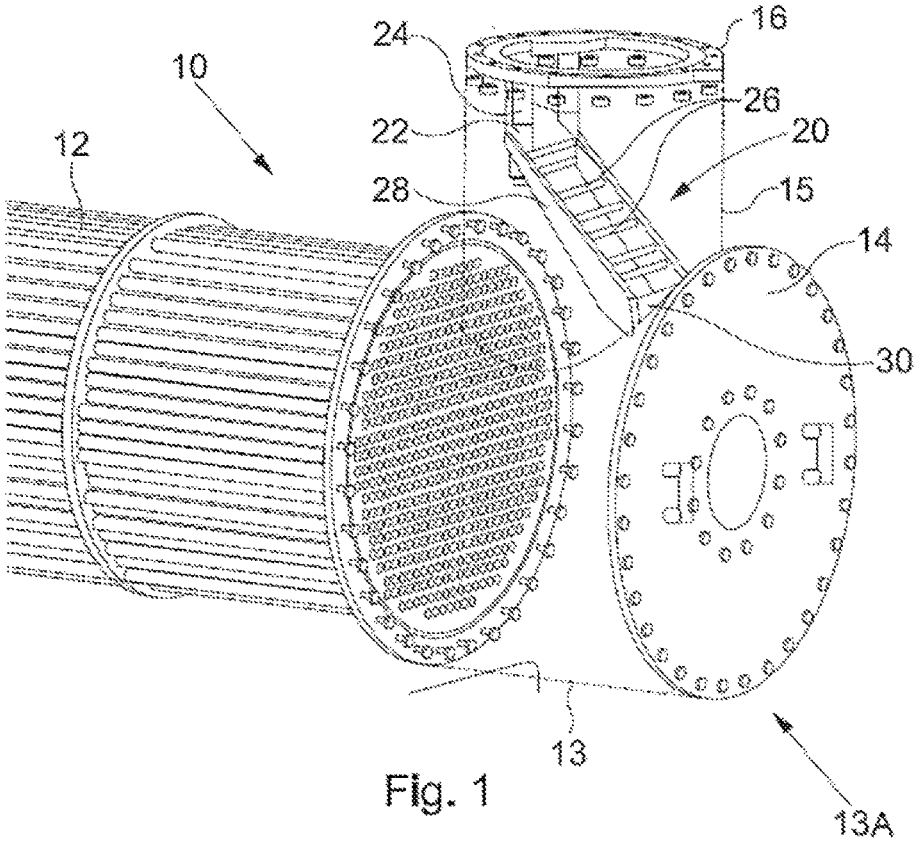
FIG. 1 is a perspective view of a heat exchanger of the invention in which the intake header and the intake pipe have been omitted and their outlines have been drawn in dotted lines.

FIG. 1 shows one end of a heat exchanger 10 having a tube bundle 12 opening into an intake header 13A. Part of the intake header has been omitted so that its contents can be seen more clearly but its outline has been drawn in dotted lines. The header tank essentially comprises a cylindrical sleeve 13 (shown in dotted lines) with an end cap 14 and an intake pipe 15 (again shown in dotted lines) connected at right angles to the sleeve 13. Only the connection flange 16 of the intake pipe and the end cap 14 of the header 13A are shown in solid lines in FIG. 1.

As so far described, the construction of the heat exchanger is conventional and will be clear to the person skilled in the art without the need to describe the discharge header. As is also well known, the bundle may be surrounded by a shell through which a second fluid flows to cool or heat the process fluid within the tubes of the bundle 12.

The essential difference between the illustrated embodiment of the invention and the prior art resides in the provision of a baffle assembly 20 that is mounted within the intake pipe 15. The baffle assembly 20 is shown in perspective view in FIG. 1 and in two different section planes in FIGS. 2 and 3, respectively.

In the absence of the baffle assembly 20, the fluid flow rates within the tubes at the top and at the sides of the tube bundle 12, as viewed, would be reduced compared to the flow rates within the tubes in the middle and at the lower end of the bundle. The purpose of the baffle assembly 20 in FIGS. 1 to 3 is to ensure that the flow rates through the different tubes of the bundle 12 are rendered more uniform.

The baffle assembly 20 has two mounting spigots 22 at its upper end by which it is bolted to the connection flange 16 of the intake pipe by way of spacers 24 so that it is located predominantly within the intake pipe 15 with only its lower end, as shown, protruding slightly into the header. The baffle assembly 20 is formed of slats 26 and two runners 28 connected to the ends of the slats 26 to form a rigid structure. As can be seen from the sections of FIGS. 2 and 3, the slats are of generally rectangular cross section, with rounded corners, and are wider at theirs ends than at their centre. At their lowermost ends, the runners 28 are connected by a cross rail 30 that is tapered to avoid generating turbulence.

An advantage of the illustrated louver-like design is that it encourages streamlined flow and if scouring projectiles are introduced into the header they may pass through the baffle assembly and will be distributed more evenly between the different tubes.

Figure 2:
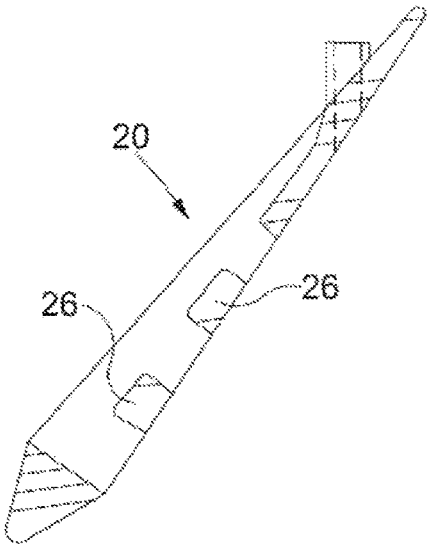
FIG. 2 is a section through the baffle of FIG. 1 taken through the central plane of symmetry.
Figure 3:
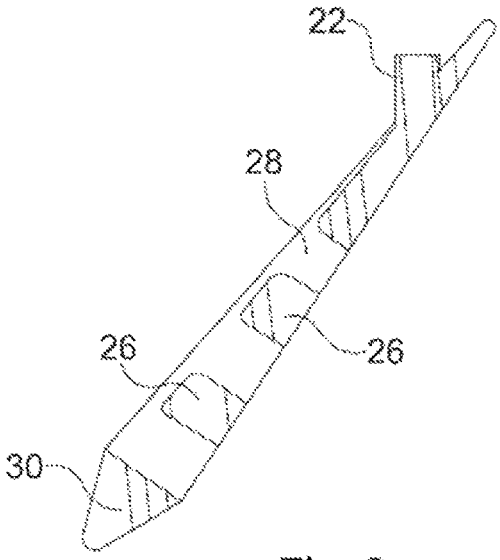
FIG. 3 is a section through the baffle of FIG. 1 taken through a plane near one end of the slats passing through one of the mounting spigots.
Figure 6:
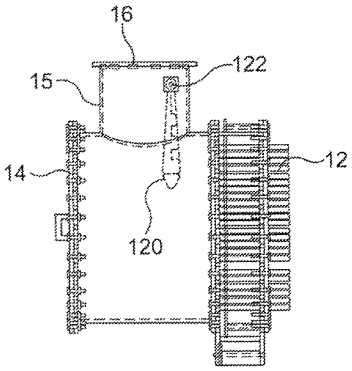
FIGS. 5 and 6 are side views showing different possible positions of the baffle assembly in the embodiment of FIG. 4.
Figure 5:
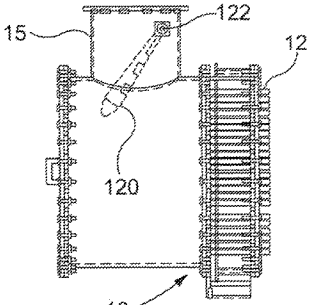
Figure 4:
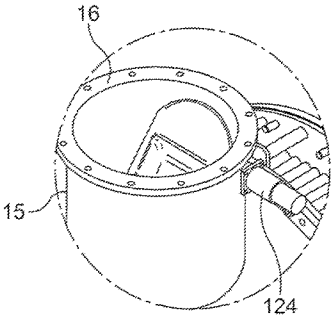
FIG. 4 shows the mouth of the intake pipe of a second embodiment of the invention.

The embodiment of FIGS. 4 to 6 differs from the embodiment of FIGS. 1 to 3 in that the baffle assembly is pivotable, as can be seen from its alternative positions shown in dotted lines in FIGS. 5 and 6. The elements of the heat exchanger are the same and have been allocated the same reference numeral to avoid repetition. The baffle assembly 120 in this embodiment is mounted on an axle 122 that passes through the wall of the intake pipe 15 and is connected to an electric motor 124 mounted outside the intake pipe and the heat exchanger.

It is possible for the baffle assembly 120 to be designed to equalise flow in the tubes of the bundle 12 and to remain at all times in the deployed position shown in FIG. 5. As the baffle may slow down the rate of fluid flow, it may be moved to a parked position shown in FIG. 6 during normal operation and only moved to the deployed position from time to time.

In the case of the baffle assembly of FIG. 6, it is possible for it to be designed to deflect the flow away from the tubes near the intake pipe towards the more distant tubes. In this case, when the baffle is deployed the flow rate will not be equalised across the tubes. However, by pivoting the baffle assembly, it will be possible to divert the flow as required, or periodically, towards the tubes through which the fluid normally flows more slowly and thereby ensure that those tubes do not become blocked.

It will be noted that in both embodiments, the baffle assembly is held only by its end adjacent the flange 16 of the intake pipe 15 and that it is dimensioned to be able to pass entirely through the intake pipe. These features allow the baffle assembly to be retrofitted to existing heat exchangers without the need to remove the intake header.

The invention claimed is:

1. A heat exchanger having an intake header, a discharge header, a bundle of tubes extending in parallel with one another between the intake header and the discharge header, an intake pipe connected to the intake header and extending transversely to the axes of the tubes of the bundle, the intake pipe having a first end opening into the header and a second end connectable to a process fluid supply pipe, and a baffle assembly for modifying the direction and rate of flow of the process fluid through the intake header, the baffle assembly being located within the intake pipe and secured to the intake pipe at a position adjacent the second end of the intake pipe, wherein the baffle assembly comprises a plurality of slats lying in planes generally parallel to one another and inclined to the direction of fluid flow, and runners connected to the ends of the slats to form a rigid structure;

wherein the baffle assembly is secured to the intake pipe for pivotal movement about an axle located near the second end of the intake pipe.

2. The heat exchanger as claimed in claim 1, wherein the baffle assembly is located at least predominantly within the intake pipe.

3. The heat exchanger as claimed in claim 1, wherein the individual slats have a width that varies along their lengths and are shaped to promote streamline flow through the header from the intake pipe to the tubes of the bundle.

4. The heat exchanger as claimed in claim 1, wherein the baffle assembly is configured to equalize the flow rate of the process fluid through the different tubes of the bundle.

5. The heat exchanger as claimed in claim 1, wherein the axle is firmly connected to the baffle assembly and extends through the wall of the intake pipe to enable the attitude of the baffle assembly to be varied from outside the heat exchanger.

6. The heat exchanger as claimed in claim 5, wherein an electric motor is provided outside the intake pipe for rotating the axle to position the baffle plate.

* * * * *